United States Patent [19]

Cuschera

[11] 4,455,693

[45] Jun. 26, 1984

[54] SELF-CONTAINED, TWO-PIECE GASKET SEAL ASSEMBLY FOR DRAINS

[76] Inventor: Casper Cuschera, 800 Durham Rd., Fremont, Calif. 94538

[21] Appl. No.: 388,648

[22] Filed: Jun. 15, 1982

Related U.S. Application Data

[63] Continuation-in-part of Ser. No. 246,298, Mar. 23, 1981.

[51] Int. Cl.[3] ..... A47K 1/14

[52] U.S. Cl. ..... 4/286; 277/112

[58] Field of Search ..... 277/190, 191, 112, 207 A; 4/286, 287

[56] References Cited

U.S. PATENT DOCUMENTS

| | | | |
|---|---|---|---|
| 1,928,259 | 9/1933 | McCabe | 277/112 |
| 2,924,472 | 2/1960 | Bush | 277/190 |
| 2,935,349 | 5/1960 | Burgh | 277/190 |
| 4,146,939 | 4/1979 | Izzi | 4/286 |
| 4,332,393 | 6/1982 | Cuschera | 277/112 |
| 4,412,361 | 11/1983 | Cuschera | 4/286 |

*Primary Examiner*—Robert I. Smith

*Attorney, Agent, or Firm*—Harris Zimmerman; Howard Cohen

[57] ABSTRACT

A self-contained, two-piece gasket sealing arrangement for drains and pipe connections includes a sleeve-like, cylindrical sealing gasket which is adapted to be secured about a pipe. The gasket includes a deep annular groove extending in one end thereof parallel to the axis of the gasket. A second gasket member includes a generally cylindrical, sleeve-like portion which is adapted to be received within the annular groove of the first gasket member. The second member includes a plurality of slot openings extending longitudinally therein and aligned with screw holes extending in one end of the second member. The first gasket member is provided with similarly spaced screw holes extending in one end thereof. A pair of compression rings are also provided, one of the rings including threaded posts extending parallel to the axis of the assembly and received in the screw holes of the first gasket member. A plurality of screws are passed through one compression ring, through the screw holes and the slots of the second gasket member, to be threadedly received in the bosses of the other compression ring.

3 Claims, 3 Drawing Figures

SELF-CONTAINED, TWO-PIECE GASKET SEAL ASSEMBLY FOR DRAINS

REFERENCE TO RELATED APPLICATION

This application is a continuation-in-part of application Ser. No. 246,298, filed Mar. 23, 1981, for which priority is claimed.

BACKGROUND OF THE INVENTION

The following U.S. patents comprise the closest known prior art:

| | | |
|---|---|---|
| 1,994,789 | 2,444,340 | 3,393,409 |
| 3,579,670 | 3,703,302 | 3,481,632 |
| 3,420,552 | 1,503,421 | 3,668,718 |
| 3,896,511 | 4,092,745 | 4,059,289 |

As shown in the references enumerated above, the prior art discloses various arrangements for securing and sealing a pipe within a drain body or the like. Many of these prior art arrangements employ a resilient gasket which is interposed between the pipe and the drain to effect a seal therebetween.

Generally speaking, the gasket arrangements known in the prior art are designed for use in conjunction with specific drain components, pipe connections, or the like. Thus each gasket arrangement is unique, and the various gasket arrangements are not interchangeable among the various drain devices which are currently commercially available. As a result, the economies of scale known to standardized, mass produced items in the plumbing field and other fields have not been available to self sealing drain devices and the like which employ resilient gasket assemblies.

SUMMARY OF THE PRESENT INVENTION

The present invention generally comprises a self-contained sealing gasket assembly which is adapted to be used as a standardized component in a wide variety of drain connections, pipe connections, and the like. The assembly of the present invention includes a pair of compression rings, each provided with a large bore extending axially therethrough. One of the rings is provided with a plurality of screw holes extending parallel to the axis thereof, while the other ring is provided with a like plurality of tapped holes formed in posts which are positioned in alignment with the screw holes of the other ring.

The pair of rings is spaced apart in the axial dimension, and a sleeve-like first sealing gasket is disposed therebetween. The gasket includes a like plurality of screw holes extending in one end and adapted to receive the bosses of one of the compression rings therein. Extending in the other end of the first gasket member is a deep annular groove which has a depth almost equal to the axial length of the gasket member.

A second gasket member is also provided, comprising a generally cylindrical, hollow member formed of resilent rubber, plastic, or the like. One end of the second gasket member is provided with a like plurality of screw holes having the same spacing as the other members, the screw holes extending parallel to the axis of the assembly. A plurality of slot openings extend axially into the second gasket member from the other end thereof, and are aligned with the screw holes therein. The second gasket member is adapted to be received into the deep annular groove of the first gasket member, with the compression rings disposed at the axially opposed ends of the assembly. A plurality of screws extend through the screw holes of the first and second gasket members to be received in the bosses of one of the compression rings. When the assembly is secured about a drain pipe or the like, and the screws are tightened in their threaded engagement, the compression rings are drawn together to compress the two piece gasket assembly in the axial direction and cause expansion thereof in the radial direction. As a result, a leak proof seal is formed with the pipe about which the assembly is secured and with a drain connection or drain body in which the assembly is disposed.

DESCRIPTION OF THE PREFERRED EMBODIMENT

Figure 1:
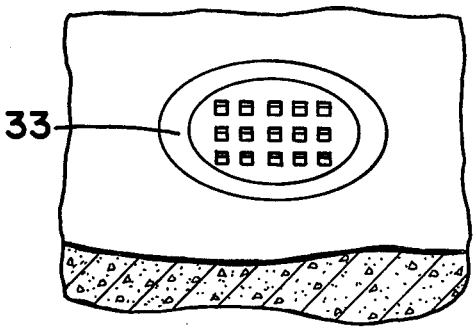
FIG. 1 is a perspective view of a typical drain fitting which employs the self-contained sealing gasket assembly of the present invention.
Figure 2:
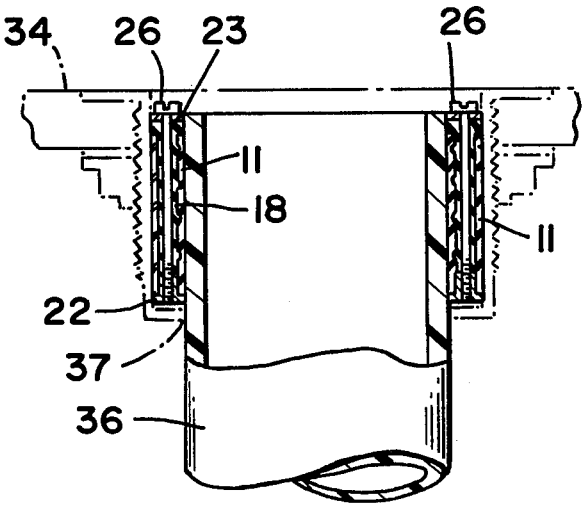
FIG. 2 is a cross-sectional elevation of the self-contained sealing gasket assembly of the present invention, shown in use with a typical floor drain.
Figure 3:
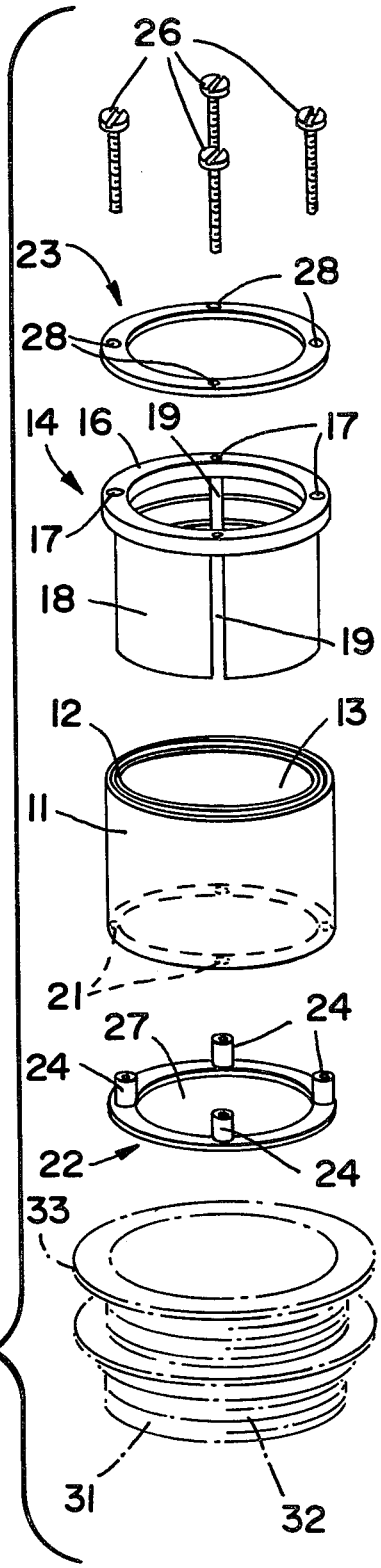
FIG. 3 is an exploded view of the components of the self-contained sealing gasket assembly of the present invention.

The present invention generally comprises a self-contained sealing gasket assembly which is adapted to be used as a standardized component in a wide variety of drain connections, pipe connections, and the like. With reference to FIGS. 1–3, the assembly includes a sleeve-like gasket member 11 which is cylindrical in configuration and includes a bore 13 extending axially therethrough. The gasket member 11 is formed of a resilient sealing material such as rubber, plastic, or the like. The gasket member 11 includes a deep annular groove 12 extending into the upper end surface thereof and having an axial dimension which is almost equal to the axial length of the gasket member 11. Formed in the lower end of the member 11 is a quartet of equally spaced screw holes 21, the holes 21 extending into and communicating with the annular groove 12.

The assembly of the present invention also includes another gasket member 14 which includes a generally cylindrical, hollow portion 18. At the upper end of the portion 18, a flange 16 extends radially both inwardly and outwardly. Extending into the end surface of the portion 16 is a quartet of equally spaced screw holes 17, the arrangement of the holes 17 being identical to the arrangement of the holes 21. Furthermore, a quartet of slot openings 19 extend into the portion 18 from the lower end thereof. The axial extent of the slot openings 19 is the entirety of the axial length of the portion 18. Moreover, each of the slot openings 19 is aligned parallel to the axis of the member 14 and in registration with one of the screw holes 17. The gasket member 14 is also formed of a resilient rubber or plastic sealing material.

The assembly of the present invention further includes a pair of compression rings 22 and 23. The compression ring 22 is provided with an outer diameter equal to the diameter of the member 11, with a bore 27 extending through the compression ring 22. The bore 27 is substantially equal in diameter to the bore 13 of the member 11. Extending upwardly from the compression ring 22 is a quartet of generally cylindrical posts 24, each of the posts including a tapped hole extending therethrough parallel to the axis of the overall assembly. The posts 24 are adapted to be received within the holes 21 in the lower end of the member 11. The other compression ring 23 is provided with the same inner and outer diameters as the compression ring 22, and further includes a quartet of screw holes 28 extending therethrough parallel to the axis of the assembly. The compression ring 23 is adapted to impinge upon the upper end surface of the portion 16 of the gasket member 14, with the screw holes 28 disposed in registration with the screw holes 17 of the member 14.

The invention also includes a quartet of screws 26 which join the components of the assembly. The screws 26 extend through the holes 28 of the compression ring 23, and through the holes 17 of the gasket member 14. The threaded shanks of the screws 26 further extend through the slot openings 19 of the portion 18 of the gasket 14, and are received in the tapped holes in the posts 24. The posts 24 are received in the holes 21 of the member 11.

A salient feature of the present invention is that the portion 18 of the gasket 14 is received within the annular slot opening 12 in the gasket member 11. When the screws 26 are tightened in the tapped holes of the posts 24, the screws cause the compression rings 22 and 23 to translate axially each toward the other, causing axial compression of the assembled gasket members 11 and 14. As the gasket assembly is compressed axially, the portion 18 acts as a wedge to expand the gasket 11 radially outwardly and inwardly to effect a seal between a pipe and a drain or pipe fitting disposed thereabout.

For example, as shown in FIGS. 1–3, a typical floor drain includes a drain body 31 having exterior threads 32 and a flange 33 extending radially outwardly from the upper end thereof and adapted to impinge upon a counterbore surface in a floor 34. The drain body 31 extends through a generally circular opening in the floor 34, with a pipe 36 extending upwardly through the lower opening 37 in the drain body 31. The upper end of the pipe 36 terminates below the upper end of the drain body 31.

The self-contained gasket sealing assembly of the present invention is secured about the upper end of the pipe in the narrow annular space defined between the outer surface of the upper end of the pipe and the inner bore surface of the drain body 31. To seal the drain pipe in the drain body, it is only necessary to advance the screws 26 to cause the compression rings 22 and 23 to translate axially together and compress the gasket assembly 11 and 14. The resulting radial expansion of the gasket assembly forms a firm and leak-proof seal between the inner bore of the drain body and the outer surface of the upper end of the pipe.

I claim:

1. A self-contained gasket sealing arrangement for drain and pipe connections, including a first gasket member comprising a generally cylindrical, sleeve-like member adapted to be secured about a pipe within a pipe connection, said gasket member including a deep annular groove extending in one end thereof parallel to the axis of the gasket; a second gasket member including a generally cylindrical, sleeve-like portion which is adapted to be received within said annular groove of said first gasket member, and compression ring means disposed at opposed ends of said gaskets in assembled configuration for compressing said gasket members together in the axial direction and causing said second gasket member to expand said first gasket member radially inwardly and outwardly to effect a sealing impingement on the pipe and the pipe connection, said second gasket member including a flange extending radially inwardly and outwardly from one end of said generally cylindrical, sleeve-like portion, said flange being substantially equal in inner and outer diameters to said first gasket member.

2. A self-contained gasket sealing arrangement for drain and pipe connections, including a first gasket member comprising a generally cylindrical, sleeve-like member adapted to be secured about a pipe within a pipe connection, said gasket member including a deep annular groove extending in one end thereof parallel to the axis of the gasket; a second gasket member including a generally cylindrical, sleeve-like portion which is adapted to be received within said annular groove of said first gasket member, and compression ring means disposed at opposed ends of said gaskets in assembled configuration for compressing said gasket members together in the axial direction and causing said second gasket member to expand said first gasket member radially inwardly and outwardly to effect a sealing impingement on the pipe and the pipe connection, said last mentioned means including a pair of compression rings, said first gasket member including a plurality of holes extending into the other end thereof generally parallel to the axis thereof, said holes communicating with said annular grooves, one of said compression rings including a plurality of posts extending therefrom parallel to said axis, said posts being spaced in registration with said holes in said first gasket member and adapted to be received therein, each of said posts including a tapped hole therein, and screw means extending from said other compression ring through said gasket members to be secured in said tapped holes of said posts.

3. A self-contained gasket sealing arrangement for drain and pipe connections, including a first gasket member comprising a generally cylindrical, sleeve-like member adapted to be secured about a pipe within a pipe connection, said gasket member including a deep annular groove extending in one end thereof parallel to the axis of the gasket; a second gasket member including a generally cylindrical, sleeve-like portion which is adapted to be received within said annular groove of said first gasket member, and compression ring means disposed at opposed ends of said gaskets in assembled configuration for compressing said gasket members together in the axial direction and causing said second gasket member to expand said first gasket member radially inwardly and outwardly to effect a sealing impingement on the pipe and the pipe connection, screw means extending through said gasket members for joining said compression ring means, including a plurality of screw holes extending into the other end of said first gasket member parallel to the axis thereof and communicating with said annular groove, said sleeve-like portion of said second gasket member including a plurality of slot openings extending therein parallel to said axis and aligned with said screw holes, said slot openings being dimensioned to receive said screw means without distortion of said gasket assembly.

* * * * *